United States Patent [19]

Mills

[11] Patent Number: 4,913,104

[45] Date of Patent: Apr. 3, 1990

[54] ROCKER ARM FOR OPERATING TWO VALVES

[75] Inventor: Jesse V. Mills, Toledo, Ohio

[73] Assignee: Henley Manufacturing Corporation, Hampton, N.H.

[21] Appl. No.: 278,258

[22] Filed: Nov. 30, 1988

[51] Int. Cl.[4] ..... F01L 1/18

[52] U.S. Cl. ..... 123/90.4; 123/90.41; 123/90.44

[58] Field of Search ..... 123/90.39, 90.4, 90.41, 123/90.44

[56] References Cited

U.S. PATENT DOCUMENTS

| | | | |
|---|---|---|---|
| 3,139,870 | 7/1964 | Sampietro | 123/90.41 |
| 3,142,357 | 7/1964 | Thompson | 123/90.41 |
| 4,624,223 | 11/1986 | Wherry et al. | 123/90.44 |
| 4,628,874 | 12/1986 | Barlow | 123/90.44 |
| 4,682,575 | 7/1987 | Simko | 123/90.39 |
| 4,697,473 | 10/1987 | Patel | 123/90.39 |
| 4,724,803 | 2/1988 | Williams | 123/90.39 |
| 4,791,893 | 12/1988 | Muranaka et al. | 123/90.4 |
| 4,796,483 | 1/1989 | Patel et al. | 123/90.44 |

*Primary Examiner*—Charles J. Myhre
*Assistant Examiner*—Weilun Lo
*Attorney, Agent, or Firm*—Allen D. Gutchess, Jr.

[57] ABSTRACT

A rocker arm of the cam-follower type capable of simultaneously operating two valves of a cylinder of an internal combustion engine is disclosed. In a preferred form, the rocker arm has a one-piece, cold-formed body which is of inverted U-shaped cross section throughout much of its length. The rocker arm body is of generally Y-shaped configuration as viewed from above. The extremities of the arms of the Y-shaped body are shaped to engage ends of valve stems and the extremity of the leg of the Y-shaped body has an axle on which a cam-contacting roller is rotatably mounted. An intermediate portion of the rocker arm has an upwardly-facing recess to receive an end of a pivot post.

4 Claims, 2 Drawing Sheets

ROCKER ARM FOR OPERATING TWO VALVES

This invention relates to a rocker arm for simultaneously operating two valves of a cylinder of an internal combustion engine.

Internal combustion engines with cylinders having multiple valves are becoming more common place. Such engines have at least two intake valves and at least two exhaust valves for each cylinder.

A rocker arm according to the present invention is capable of simultaneously operating two intake valves or two exhaust valves. The rocker arm preferably has a body of generally Y-shaped configuration as viewed from above and is of a one-piece, cold-formed construction. Extremities of the arms of the Y-shaped body have pads to engage ends of valve stems, the valves of which are operated simultaneously. The extremity of the leg of the Y-shaped body has an axle on which a cam-contacting roller is rotatably mounted. An intermediate portion of the rocker arm has an upwardly-facing recess for engaging a pivot post.

In a preferred form, the rocker arm body is stamped and includes side walls with a structurally integral web connecting them. Each of the arms of the body has side walls connected by a web which is formed to engage an end of one of the valve stems.

The rocker arm in accordance with the invention saves space, which is often critical in an engine having cylinders with multiple valves. The new rocker arm also reduces the number of cam-contacting rollers required, which reduces costs, moving parts, and potential maintenance problems, and results in less friction.

It is, therefore, a principal object of the invention to provide a rocker arm which is capable of simultaneously operating two valves of a cylinder of an engine.

Another object of the invention is to provide a rocker arm having a single cam-contacting roller and having means for engaging ends of two valve stems.

A further object of the invention is to provide a rocker arm for simultaneously operating two valves and having the advantages set forth above.

Many other objects and advantages of the invention will be apparent from the following detailed description of preferred embodiments thereof, reference being made to the accompanying, drawings, in which.

Figure 1:
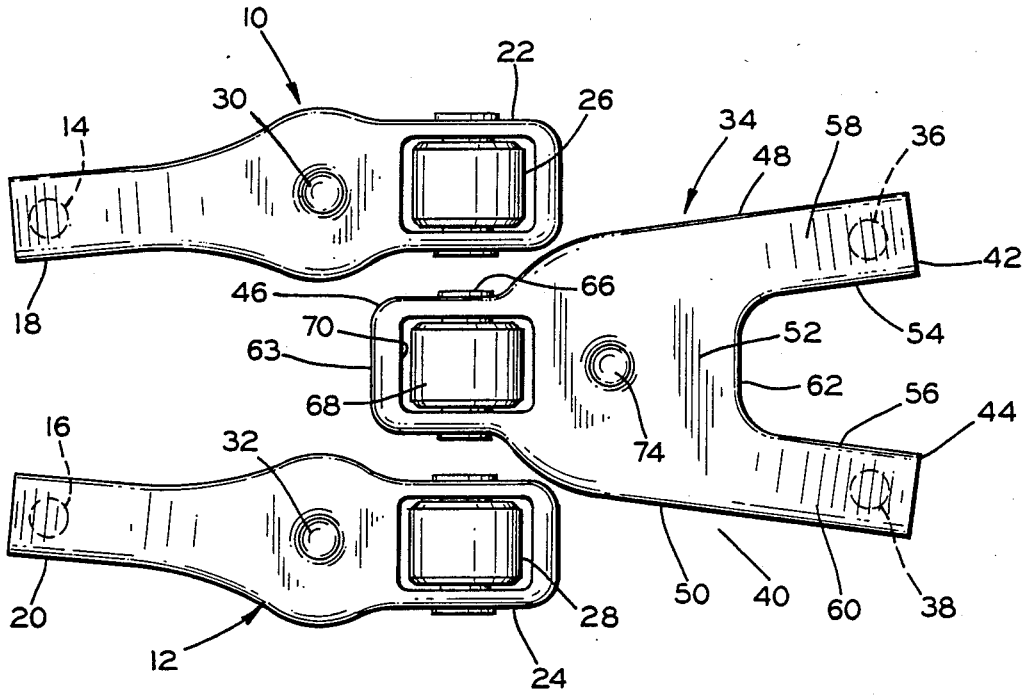
FIG. 1 is a somewhat schematic plan view of three rocker arms, including a two-valve rocker arm in accordance with the invention, in position to operate four valves of a cylinder of an internal combustion engine.

Referring to the drawings and more particularly to FIG. 1, rocker arms 10 and 12 operate valve stems 14 and 16 indicated in dotted lines, with end portions 18 and 20 of the rocker arms being shaped to receive ends of the valve stems. Other end portions 22 and 24 are curved and carry rollers 26 and 28 in axial alignment. Recesses 30 and 32 between the end portions of the rocker arms are positioned to receive pivot or lifter posts (not shown).

Figure 2:
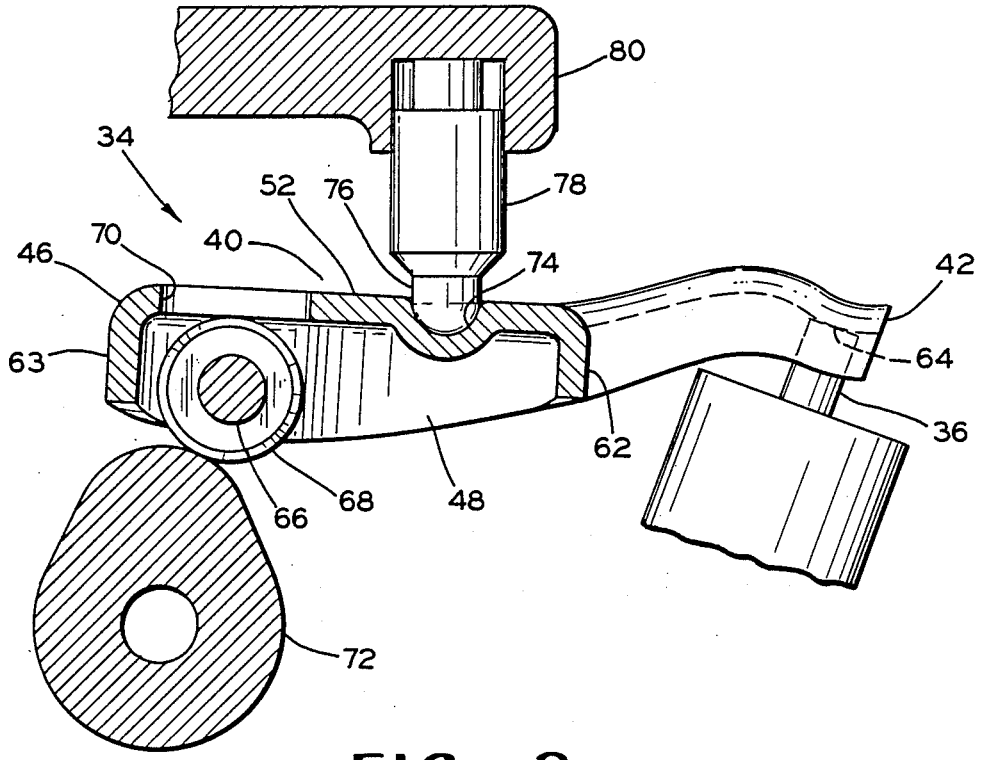
FIG. 2 is a fragmentary, somewhat schematic view in vertical cross section through the center of the two-valve rocker arm and further showing a valve stem, cam, and pviot post.
Figure 3:
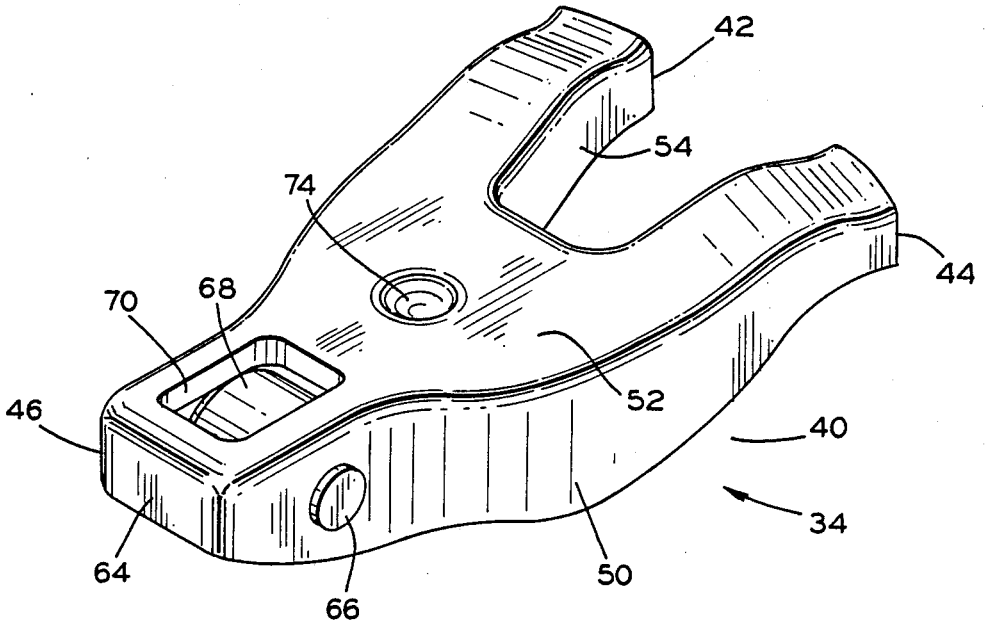
FIG. 3 is a view in perspective of the two-valve rocker arm.

A rocker arm 34 is positioned between the rocker arms 10 and 12 and operates two valve stems 36 and 38, the valve stem 36 also being shown schematically in FIG. 2. With this design, the three rocker arms 10, 12, and 34 are capable of operating all four valves of a cylinder of an internal combustion engine.

The rocker arm 34 has an elongate body 40 which is cold-formed, specifically stamped, from one sheet of metal. Such rocker arms are usually less expensive to manufacture than cast ones, particularly when manufactured in large quantities. The stamped rocker arms are also lighter in weight, an important advantage because lighter engines and vehicles result in better fuel economy and engine efficiency or, alternately, higher performance for the engine. Stamped rocker arms may also have move visual appeal than rough, cast ones.

The rocker arm 34 is of generally Y-shaped configuration as viewed from above and has first and second extremities 42 and 44 at end portions of arms of the Y-shaped body and has a third extremity 46 at an end portion of the leg of the Y-shaped body. The body 40 is generally inverted U-shaped cross section throughout its length, having outer side walls 48 and 50 joined by a main web 52. The arms of the Y-shaped body 40 also have inner side walls 54 and 56 which are connected at upper edges to the outer side walls 48 and 50 by structurally-integral narrow webs 58 and 60 so that the arms are also of inverted U-shaped configuration in transverse cross section. Inner ends of the side walls 54 and 56 are joined by a structurally-integral transverse side wall 62 which adds strength and stiffness to the rocker arm 34. A transverse end wall 63 also joins ends of the outer side walls 48 and 50 for added strength. The webs 58 and 60 at the end portions 42 and 44 are curved to form convex pads 64 (FIG. 2), for engaging the ends of the valve stems 36 and 38.

The outer side walls 48 and 50 toward the third extremity 46 of the rocker arm carry an axle 66 extending therebetween. The axle is received in round holes in the side walls which are suitably made therein in axial alignment. The outer ends of the holes can be flared and the ends of the axle can similarly be flared by staking or by spinning, as discussed more fully in Patel U.S. Pat. No. 4,697,473, issued Oct. 6, 1987. A cam-contacting roller 68 is rotatably mounted on the axle 66, preferably with needle bearings therebetween, as disclosed more fully in the aforesaid patent. A clearance hole 70 is located above the roller 68 in the main web 52 and the lower periphery of the roller extends below the lower edge of the side walls 48 and 50 to contact a cam 72 which is shown schematically. The pads 64 are on a line which is parallel to the axis of rotation of the roller 68.

An intermediate portion of the main web 52 of the rocker arm has a recess 74 therein to receive a semi-spherical end 76 of a pivot of lifter post 78, shown schematically in FIG. 2. The lifter post 78 is of a type known in the art and will not be discussed further. It is carried by an overhead support 80 which also supports lifter posts for the rocker arms 10 and 12. To achieve proper stability, it may be necessary to employ two of the recesses 74 with two lifter posts 78 in side-by-side relationship.

The operation of the rocker arm 34 is believed to be self-evident. It pivots about the lifter post 78 and moves the vale stems 36 and 38 longitudinally as the roller 68 rides on the cam 72, thereby simultaneously opening and closing the valves in the cylinder.

From the above, it will be seen that the three rocker arms are all that are needed to operate the four valves. This results in lesser weight than if four rocker arms were used. Also one less roller is required which reduces costs and results in fewer moving parts and potentially less maintenance problems. Further, space is saved in a direction longitudinally of the engine which is often of critical importance. With one less roller per cylinder, friction can also be decreased.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. A rocker arm for simultaneously operating two valves of a cylinder of an internal combustion engine, said rocker arm comprising a body of generally Y-shaped configuration as viewed from above and having main side walls connected by a main web, an axle extending between the side walls of said body, a roller rotatably mounted on said axle and positioned to contact a cam, an extremity of said body having two end portions which are spaced apart, with each of said two end portions having an inner side wall and a web extending between said inner side wall and one of said main side walls, a structurally-integral transverse wall connecting ends of said inner walls, each of said two end portions being shaped to engage an end of a valve stem of one of said valves, and said main web having means spaced from said roller for engaging a pivot post.

2. A rocker arm according to claim 1 wherein said means for engaging a pivot post is a substantially semi-spherical recess.

3. In combination, an internal combustion engine having a cylinder with at least two valves, a lifter post having a downwardly-extending, substantially semi-spherical end located at one side of said valves, means for supporting said lifter post, a cam positioned at one side of said valves, a rocker arm comprising a generally elongate body having side walls connected by a web, an axle extending between the side walls of said body, a roller rotatably mounted on said axle and positioned in contact with said cam, said body having two spaced portions shaped to engage ends of valve stems of said two valves, said portions being on a line parallel to said axle, said body having inner side walls at said spaced portions and a transverse wall extending between ends of said inner walls and being structurally integral therewith, and said web having a recess of substantially semi-spherical shape spaced from said roller for engaging said end of said lifter post.

4. A rocker arm for simultaneously operating two valves of a cylinder of an internal combustion engine, said rocker arm comprising a body having main side walls connected by a main web over a substantial portion of its length, one extremity of said body having a single end portion with an axle extending between the side walls, a roller rotatably mounted on said axle and positioned to contact a cam, the opposite extremity of said body having two end portions which are spaced apart, each of said two end portions being shaped to engage an end of a valve stem of one of said valves, each of said two end portions having an inner side wall and a web extending between said inner side wall and one of said main side walls, a structurally-integral transverse wall connecting ends of said inner side walls, and said main web having a substantially semi-spherical recess between said roller and said opposite extremity for engaging a pivot post.

* * * * *